US006209952B1

(12) United States Patent
Huang

(10) Patent No.: US 6,209,952 B1
(45) Date of Patent: Apr. 3, 2001

(54) DETACHABLE TABLE AND CHAIR ASSEMBLY

(75) Inventor: Chin-Yi Huang, Kaohsiung (TW)

(73) Assignee: Lin-Bing Liang, Kaohsiung (TW)

( * ) Notice: Subject to any disclaimer, the term of this patent is extended or adjusted under 35 U.S.C. 154(b) by 0 days.

(21) Appl. No.: 09/327,186

(22) Filed: Jun. 7, 1999

(51) Int. Cl.[7] ..... A47B 83/02

(52) U.S. Cl. ..... 297/157.1; 297/143; 297/174; 312/235.9

(58) Field of Search ..... 297/157.1, 174, 297/143, 158.3; 312/235.2, 235.3, 235.9

(56) References Cited

U.S. PATENT DOCUMENTS

| | | | | |
|---|---|---|---|---|
| 187,429 | * | 2/1877 | Skykes | 312/235.9 |
| 1,314,240 | * | 8/1919 | Besner et al. | 297/143 X |
| 1,339,669 | | 5/1920 | Rapp . | |
| 3,301,590 | * | 1/1967 | Young | 297/157.1 |
| 4,277,856 | * | 7/1981 | Damin | 297/157.1 |
| 5,547,270 | * | 8/1996 | Dang | 312/235.2 |
| 5,685,600 | | 11/1997 | Kuo . | |

* cited by examiner

*Primary Examiner*—Anthony D. Barfield
(74) *Attorney, Agent, or Firm*—Bacon & Thomas, PLLC

(57) ABSTRACT

A detachable table and chair assembly includes a table, a vertical bumper panel attached to a leading end of the table, a chair and parallel side bars movably connecting the chair to a rear end of the table. The table has spaced apart side panels mounted securely on a leading end of the side bars, and a table top mounted on a top end of the side panels. The table top has a hollow bottom part which defines a first receiving space, and a flat top part which covers the first receiving space. The chair has spaced apart side panels mounted movably on a rear end of the side bars and spaced apart transverse panels formed between the chair side panels to define a second receiving space. A seat panel is supported on the chair side panels and pivotable between a first position to close the second receiving space and a second position to access the second receiving space.

10 Claims, 8 Drawing Sheets

DETACHABLE TABLE AND CHAIR ASSEMBLY

BACKGROUND OF THE INVENTION

1. Field of the Invention

The invention relates to a table and chair assembly, more particularly to a table and chair assembly which is detachable and can be used in different ways and readily contracted so that space can be saved efficiently.

2. Description of the Related Art

U.S. Pat. No. 5,685,600 (Kuo) proposes a combined table and chair assembly providing play and storage areas for the myriad of toys, books and other assorted treasures which children are noted for collecting. Kuo shows a flat table top including 4 identical panels to cover a receiving space in the table with 2 inner folding panels pivotable lie on respective fixed panels to uncover the receiving space. It is found difficult for children to separate the folding panels from the fixed panels with fingers when trying to lift the folding panels for pivoting to cover the receiving space. Children's fingers may be accidentally snapped by the panels when laying the folding panels on the fixed panels. Also, the fixed panels extend inwardly beyond ends of the receiving space and form odd corners in the receiving space. Moreover, Kuo does not disclose a detachable structure of the table and chair assembly.

U.S. Pat. No. 1,339,669 (Rapp) proposes foldable furniture which can be converted into a bed or combination desk and settee, or folded together into the form of a box or cabinet to occupy the least possible space. Rapp shows a desk and a settee being connected together by means of longitudinal dove-tails on outer faces of the settee engaging correspondingly shaped grooves in sides of the desk. However, the longitudinal dove-tailed engagement is frictional in sliding and children have difficulty in moving the settee to extend or contract the furniture. Moreover, the uncovered sliding dove-tails are accessible by children creating a risk of injuring children's fingers and toes when sliding.

SUMMARY OF THE INVENTION

The present invention relates to a children table and chair assembly and particularly to a detachable table and chair assembly.

The primary object of the present invention is to provide a detachable table and chair assembly in which the chair is movably connected to a table and adapted to contract and fit in the table so that space can be saved efficiently when not in use.

Another object of the present invention is to provide a detachable table and chair assembly which is formed with storage compartments in the table and chair.

A further object of the present invention is to provide a detachable table and chair assembly which has a foldable top pivotable to open and provide access to the storage compartment in the table.

A still further object of the present invention is to provide a detachable table and chair assembly which has a play area on top of the table and adjacent to the chair.

A still further object of the present invention is to provide a detachable table and chair assembly which is safe in structure for children to use.

A still further object of the present invention is to provide a detachable table and chair assembly which can be dismantled for packing.

Accordingly, the detachable table and chair assembly of the present invention comprises a table, a bumper panel attached to a vertical end of the table and a chair movably connected to the table with a pair of parallel side bars. The table has spaced apart side panels mounted securely on one end of the side bars, a first bottom piece transversely supported on the side panels to define a first receiving space and a flat table top mounted on top of the side panels to cover the first receiving space. The table top includes a fixed panel adjacent to the chair and secured to the table side panels and a folding panel disposed between the fixed panel and bumper panel and pivotally connected to the fixed panel so as to be pivotable between a first position to close the first receiving space and a second position to access the first receiving space. The chair has spaced apart side panels mounted on the side bars and movable towards and away from the table side panels, spaced apart front and rear panels disposed between the chair side panels to integrally define a second receiving space, a second bottom piece supported on the front and rear panels to close a bottom opening of the second receiving space and a seat panel pivotally mounted on an open top end of the second receiving space so as to be pivotable between a first position to close the second receiving space and a second position to access the second receiving space.

Preferably, an inner end of the fixed panel of the table top terminates at an outer end of the first receiving space so as to diminish any odd corner in the first receiving space and, in the second position, the folding panel extends outwardly beyond the fixed panel to provide an extension for children to grasp with fingers in swinging the folding panel.

Preferably, conventional ball-bearing tracks are used in the side bars in which the ball-bearing tracks engage chair side panels and side bars so that the chair is slidable towards and away from the table smoothly.

Preferably, table side panels and chair side panels are respectively secured to the side bars to form substantially flat side combinations and the transverse panels including the bumper panel, table top, chair front and rear panels, first and second bottom pieces are supported on the side combinations so that the assembly can be dismantled and stacked for packing.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENT

Figure 1:
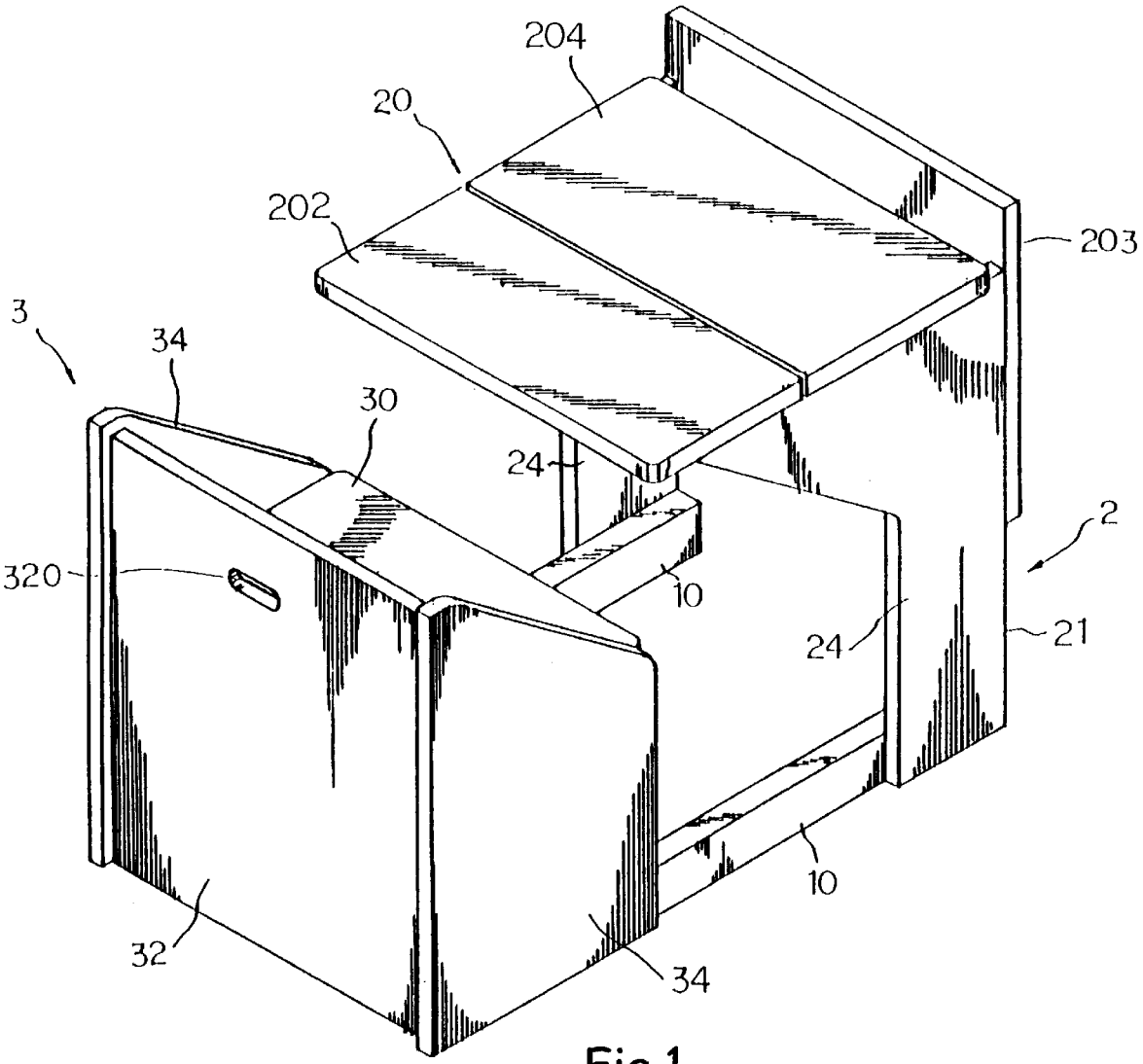
FIG. 1 is a perspective view of the preferred embodiment of a detachable table and chair assembly according to the present invention.
Figure 2:
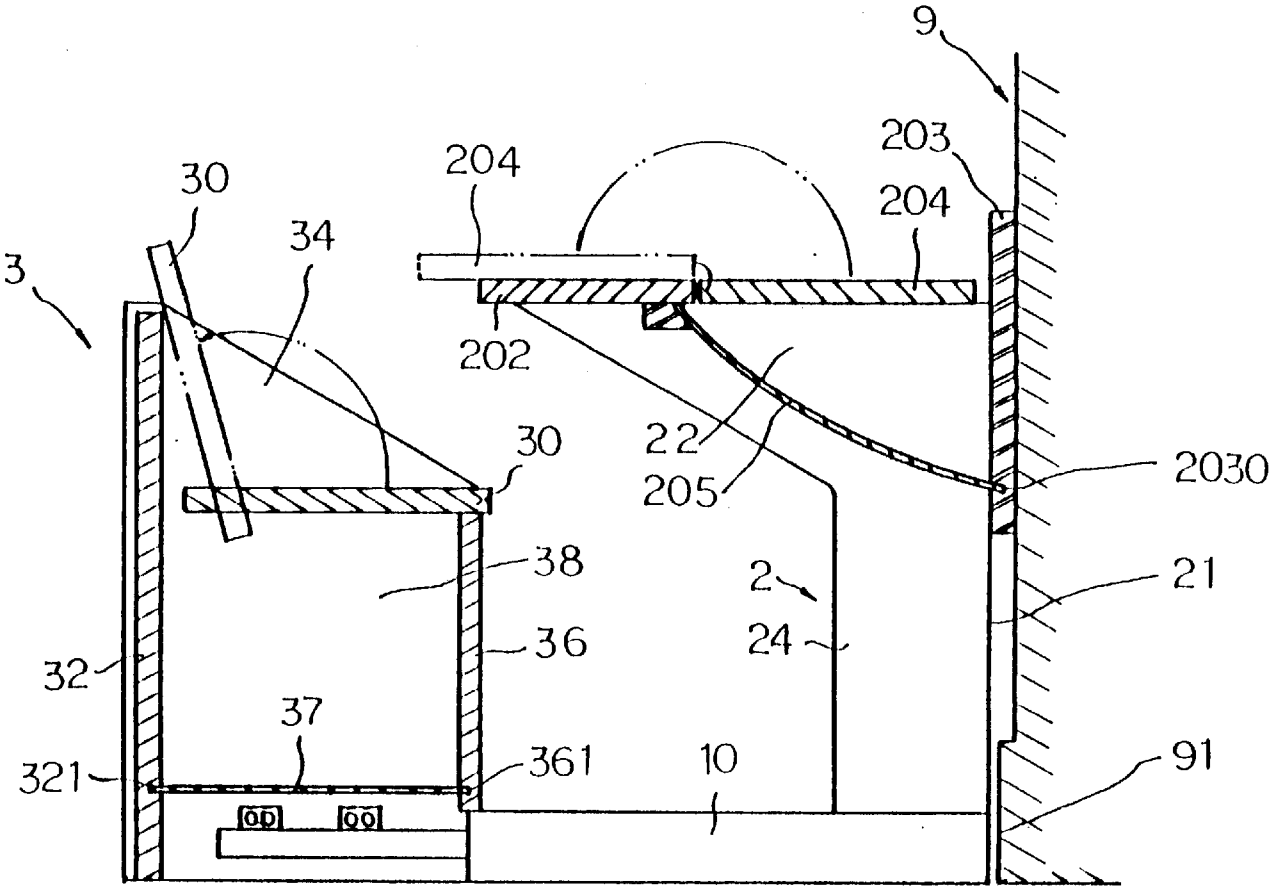
FIG. 2 is a sectional view of the preferred embodiment when in a fully extended position.

Referring to FIGS. 1 and 2, the preferred embodiment of a detachable table and chair assembly according to the present invention is shown to comprise a table 2, a chair 3 connected to the table 2 with a pair of parallel side bars 10 and a bumper panel 203 secured to a vertical end 21 of the table 2 opposed to the chair 3.

The table 2 has spaced apart side panels 24 with the lower ends secured to a leading end of the side bars 10. A first bottom piece 205, preferably made of plywood sheet, is formed between the side panels 24 together with the bumper panel 203 to define a first receiving space 22 in the table 2. A flat table top 20 is provided on top of the side panels 24 to cover the first receiving space 22. The table top 20 comprises a fixed panel 202 affixed to a side portion adjacent to the chair 3 and spaced apart so as to provide an opening between the fixed panel 202 and bumper panel 203 communicating with the first receiving space 22 to provide access to the first receiving space 22 through the table top 20. The table top 20 also comprises a folding panel 204 formed between the fixed panel 202 and bumper panel 203 and pivotally connected to the fixed panel 202 so as to be movable between a first position, wherein it covers the opening to close the first receiving space 22, and a second position, wherein the opening is uncovered to provide access to the first receiving space 22.

Preferably, a leading or inner end of the fixed panel 202, which connects the folding panel 204, terminates at or adjacent to the outer end of the first receiving space 22 so as to diminish any odd corner in the receiving space 22 and allow a full opening of the receiving space 22 when moving the folding panel 204 away from its first position. Also, the fixed and folding panels 202, 204 can be the same in width, but are preferably different in length. As shown in FIG. 2, in the second position, the folding panel 204 extends beyond the fixed panel 202 towards the chair 3 to provide a relatively larger play area, which reaches close to the chest of a child sitting in the chair 3 playing.

The chair 3 has spaced apart side panels 34 and spaced apart front panel 36 and rear panel 32, which are transversely disposed between the side panels 34, all together to define a second receiving space 38. A seat panel 30 is mounted pivotally on an open top of the second receiving space 38 so as to be movable between a first position, wherein it covers the open top to close the receiving space 38, and a second position, wherein the open top is uncovered to provide access to the receiving space 38. A bottom piece 37, preferably made of plywood sheet, is horizontally disposed at a lower portion of the chair 3 to close a bottom opening of the receiving space 38. A pair of grooves 361, 321 extend horizontally in inner sides of the front and rear panels 36, 32 for receiving lateral ends of the second bottom piece 37. A through hole 320 is formed at a top portion of the rear panel 32 to facilitate sliding movement of the chair 3 relative to the table 2.

Figure 3:
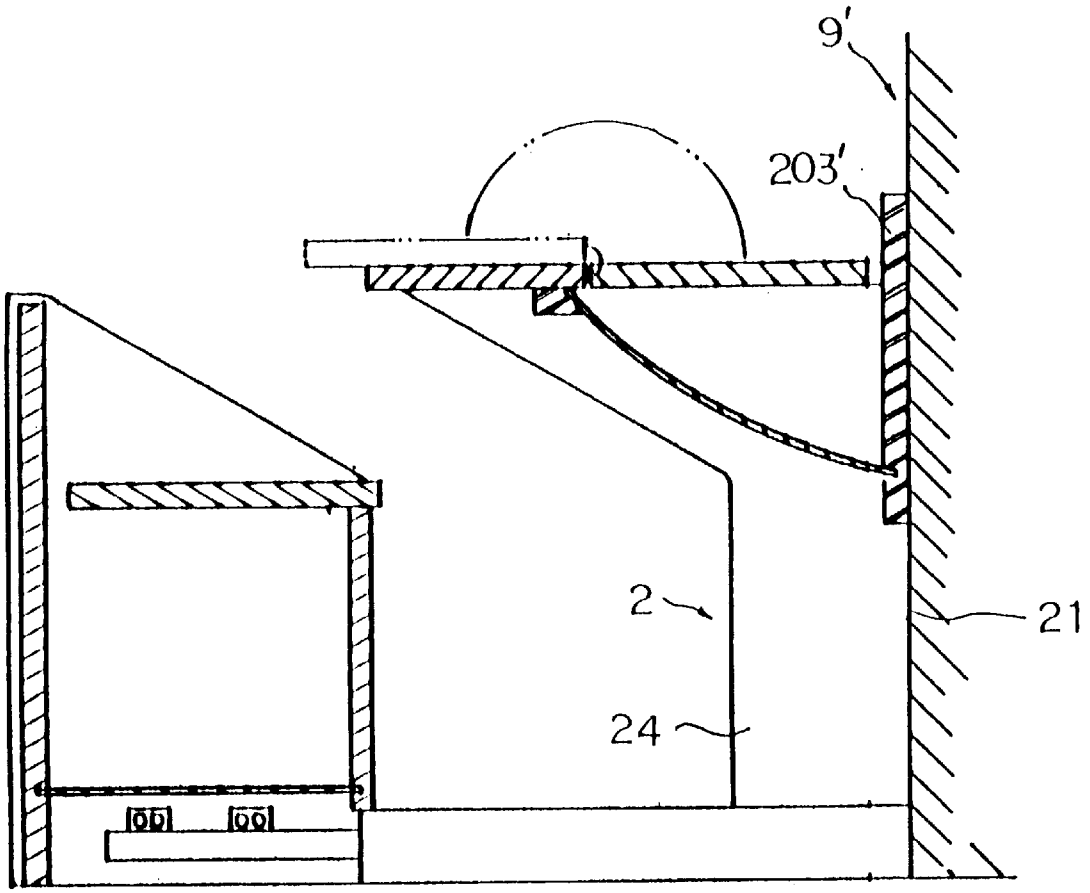
FIG. 3 is a sectional view of another preferred embodiment when in a fully extended position.

The detachable table and chair assembly of the present invention can be positioned against a wall 9 by attaching the bumper panel 203 to the wall 9 so as to skip over a corner projection 91. Top end of the bumper panel 203 projects upwardly over the table top level so as to hinder articles, such as pens, falling off the leading end of the table top 20. Referring to FIG. 3, a bumper panel 203' can also be secured to the side panels 24 inset into the leading end 21 so that the leading end 21 can be fully attached to a vertical wall 9'.

Figure 4:
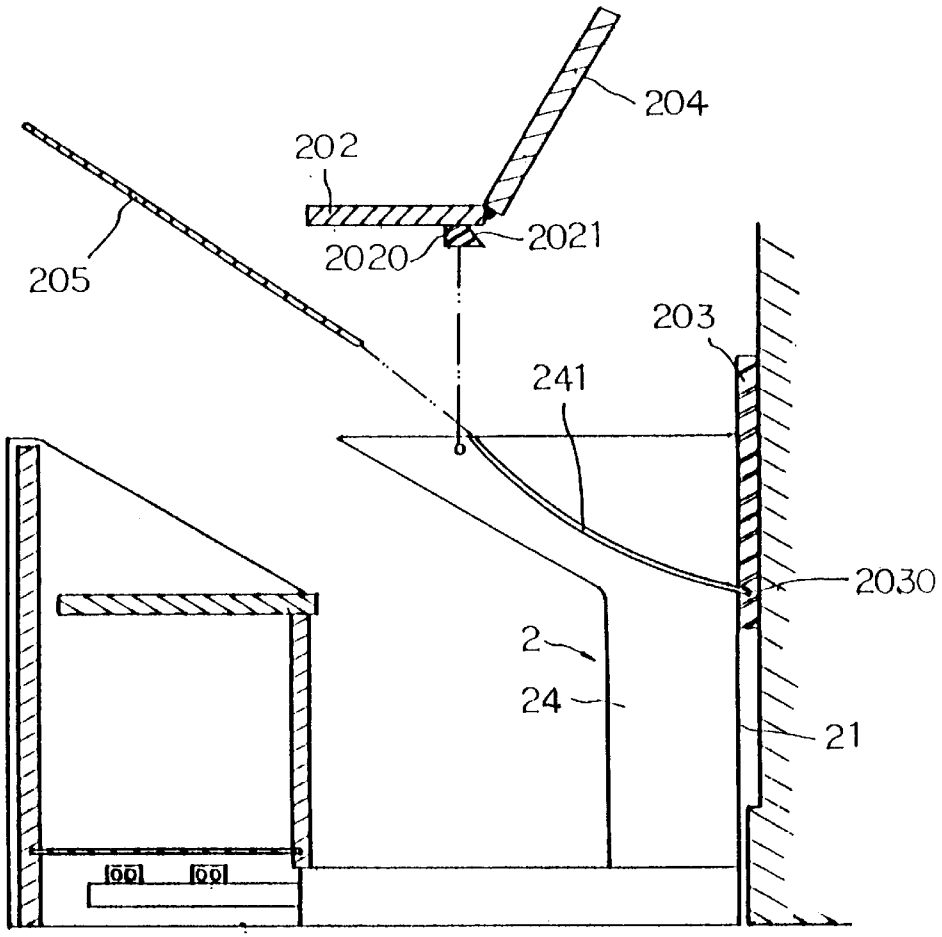
FIG. 4 is a sectional and diagrammatic view of the preferred embodiment.

Referring to FIG. 4, inner sides of the table side panels 24 are formed with a pair of grooves 241 each slanting from the top to the front end 21 of one of the side panels 24 to communicate with a groove 2030, which extends transversely horizontally in an inner side of the bumper panel 203. A bracket 2020 is attached to the bottom of the fixed panel 202 and cut to form a notch 2021 between the fixed panel 202 and bracket 2020. The first bottom piece 205 can be supported on the side panels 24 with lateral ends engaging the grooves 241 and a leading end engaging the transverse groove 2030. Sequentially, the fixed panel 202 can be mounted on top of the side panels 24 by securing the bracket 2020 to the side panels 24 by means of screws whereas a rear end of the bottom piece 205 can be received by the notch 2021.

Figure 5:
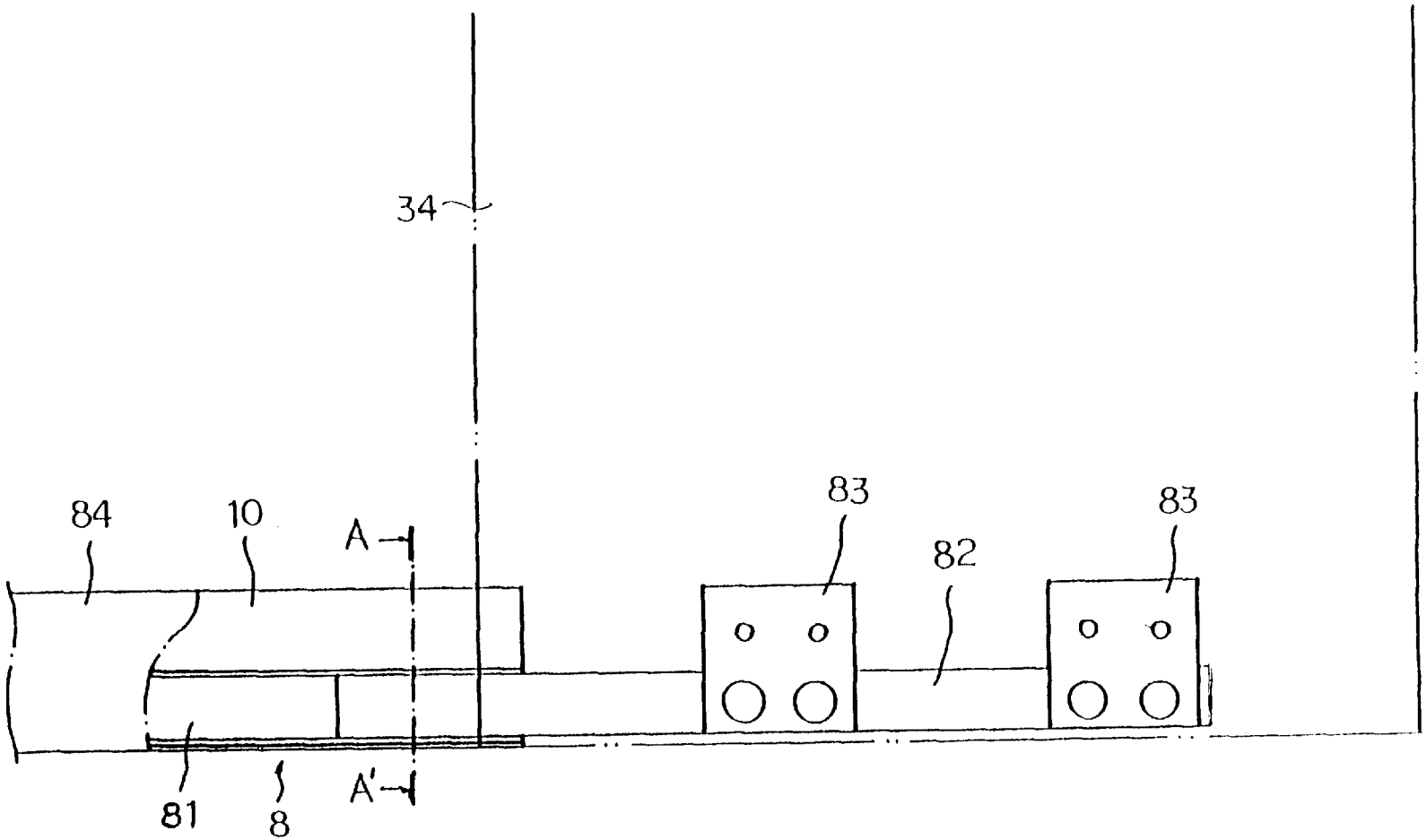
FIG. 5 is sectional view of a side bar of the preferred embodiment according to the present invention.
Figure 6:
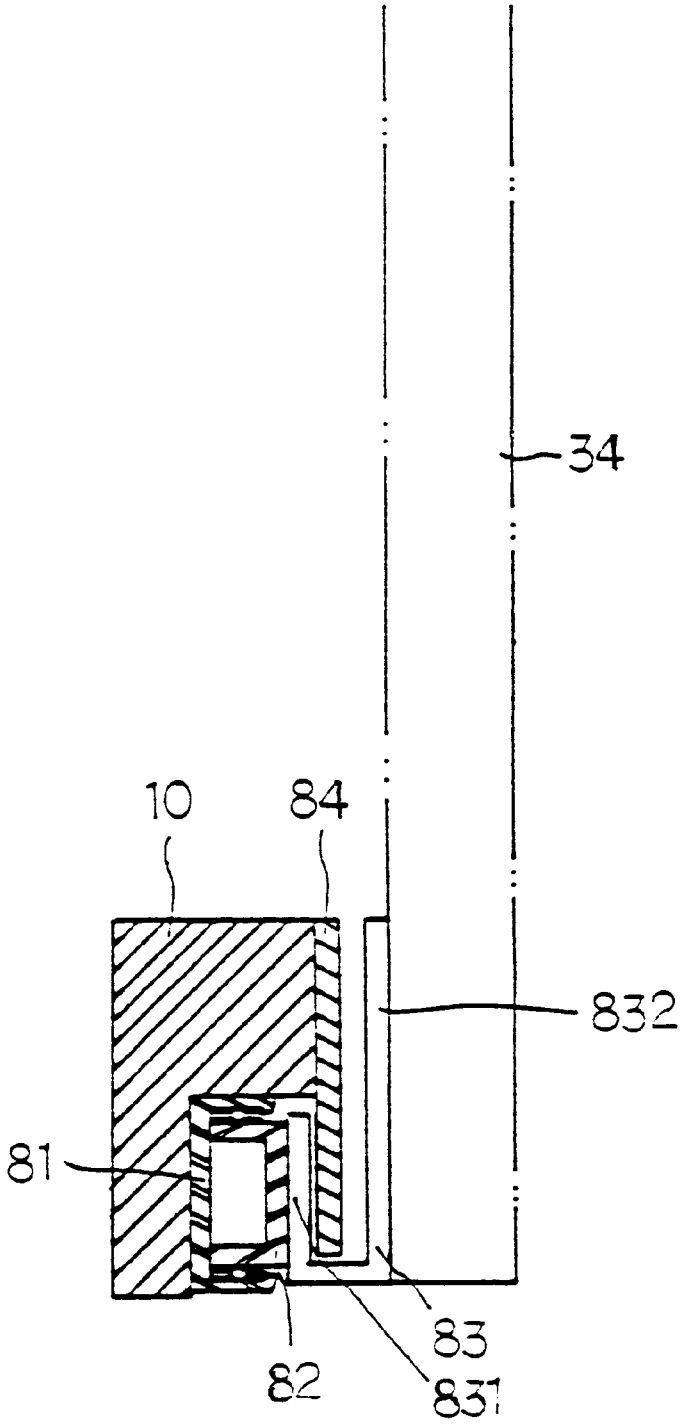
FIG. 6 is a sectional view of the side bar, taken along line A–A' in FIG. 5, to illustrate the structural relationship between a conventional ball-bearing track and the side bar of the preferred embodiment.

In order to slide the chair 3 towards and away from the table 2 smoothly to enable children to do so alone, a conventional ball-bearing track is used by the present invention. Referring to FIGS. 5 and 6, the conventional ball-bearing track 8 mainly includes a generally U-shaped channel track 81 and a channel 82 telescopically mounted in the channel track 81 with a plurality of small steel balls engaging in between to prevent friction during sliding. The side bar 10 comprises a generally reverse L-shaped wooden bar with a recess for receiving the ball-bearing track 8. A major side wall of the channel track 81 is formed with screw holes (not shown) for firmly securing the channel track 81 to the wooden bar 10 by means of screws (not shown). A generally U-shaped bracket 83 is provided for engaging the chair side panel 34 with the track 8. An inner vertical side wall 831 of the bracket 83 is attached to a major side wall of the channel 82 and an outer vertical side wall 832 is attached to an inner side of the chair side panel 34. A shield piece 84, preferably made of plywood sheet, extends longitudinally along the bar 10 and projects downwardly from top of the bar 10 into a gap between the inner and outer side walls 831, 832 of the bracket 83. By so doing, the ball-bearing track 8 and inner side wall 831 of the bracket 83 are covered by the shield piece 84 and the outer side wall 832 is covered by the side panel 34. Also, the side panel 34 is movable beside the side bar 10 through telescopic movement of the ball-bearing track 8.

Figure 7:
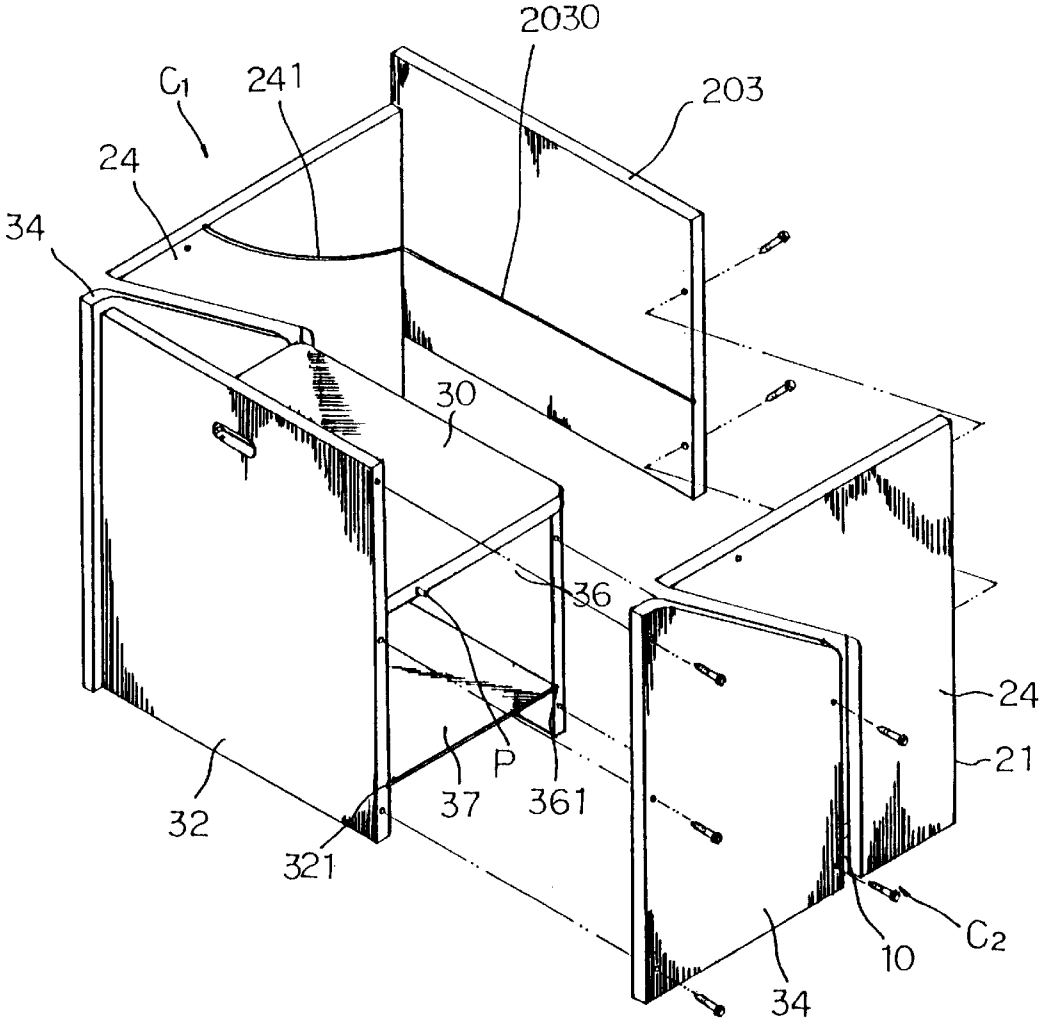
FIG. 7 is a diagrammatic and explosive view of the preferred embodiment excluding parts of table top and bottom piece.
Figure 8:
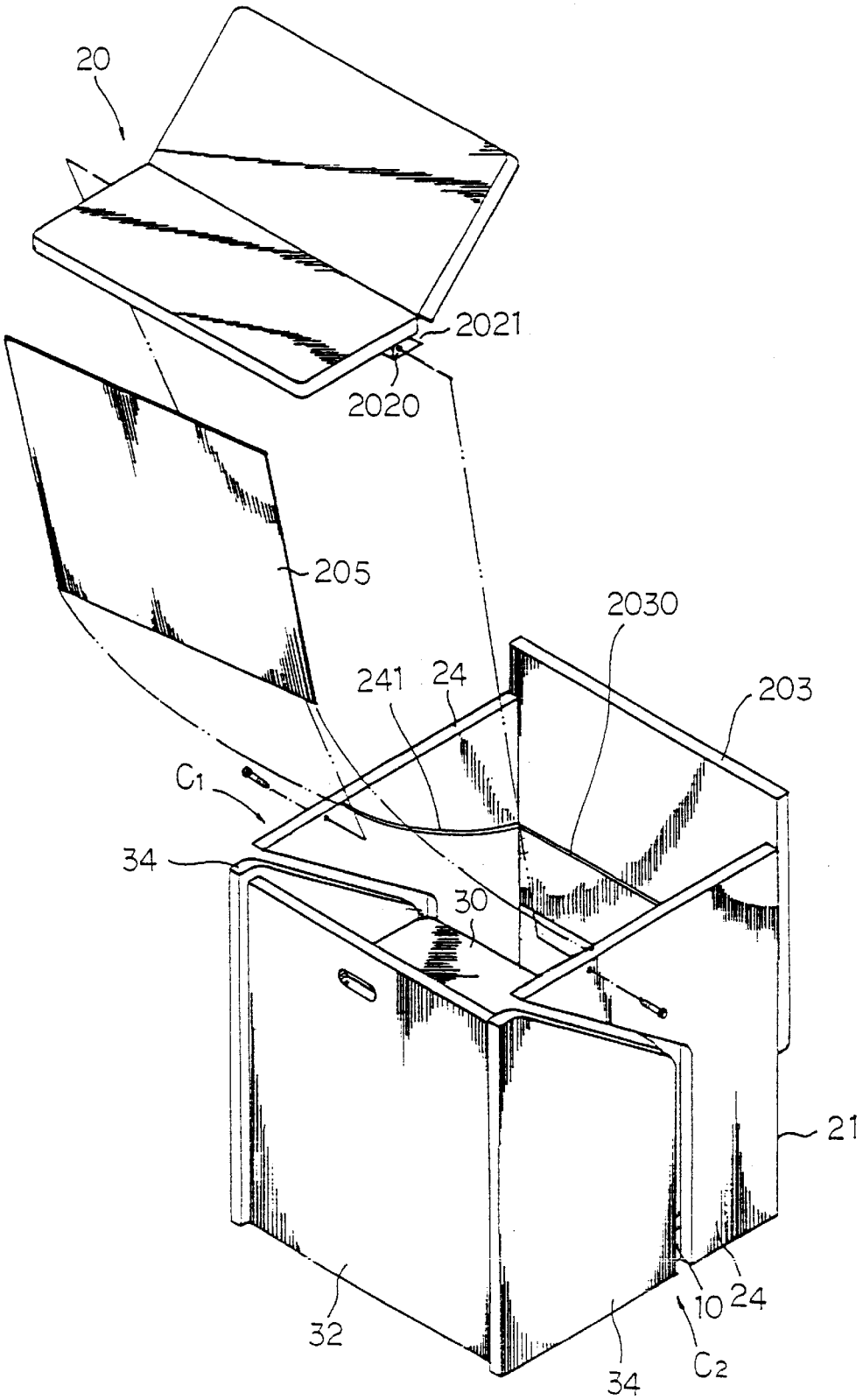
FIG. 8 is a diagrammatic and explosive view of the preferred embodiment according to the present invention.

Referring to FIGS. 7 and 8, in order to minimize packing size, the assembly can be dismantled into 2 flat side combinations C1, C2 and assorted panels. Each of the side combinations C1, C2 includes a table side panel 24 and a chair side panel 34 secured to a side bar 10 in a way as previously described. The assorted panels include the bumper panel 203, front panel 36, rear panel 32, seat panel 30, table top 20 and first and second bottom pieces 205, 37. All the side combinations and panels can be properly stacked to reduce space for packing in a box. Step by step assembly as shown in FIG. 7 is as follows: a) front and rear panels 36, 32 are perpendicularly attached to the inner side of the chair side panel 34 of an up-raised side combination C1 and secured by means of screws, which extend through the chair side panel 34; b) the second bottom piece 37 is supported on the front and rear panels by engaging the lateral ends in the grooves 321, 361; c) the seat panel 30 is pivotally disposed above the bottom piece 37 by means of a pivot pin (not shown) with an end of the seat panel 30 remote from the pin and supported by the front panel 36; d) the other side combination C2 is upraised to receive another pivot pin P and then secured by means of screws, which extend through the chair side panel 34 thereof; e) the bumper panel

203 is attached to the front end 21 of the side panels 24 and then secured by means of screws, which extend through the bumper panel 203 as shown in FIG. 8; f) the first bottom piece 205 is supported on the spaced apart side panels 24 by engaging the lateral ends in the grooves 241 and a leading end in the transverse groove 2030 of the bumper panel 203; g) the table top 20 is mounted on top of the side panels 24 by securing the bracket 2020 to the side panels 24 by means of screws, which extend through the side panels 24 so as to receive a rear end of the first bottom piece 205 under the table top.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A detachable table and chair assembly, comprising:

a table having spaced apart side panels, each formed with a flat top end, a leg end and a vertical leading end, a first bottom piece transversely formed between the side panels to define a first storage space, and a flat table top mounted on the flat top end of the side panels to cover the first storage space;

a chair having spaced apart side panels, each formed with a leg end, spaced apart transverse panels disposed between the side panels to integrally define a second storage space, and a seat panel pivotally mounted on an open top end of the second storage space, said seat panel being pivotable between a first position to close the second storage space and a second position to access the second storage space;

side bars in parallel relation, each having a leading end securely connecting the leg end of one of the table side panels and a rear end slidably connecting the leg end of one of the chair side panels; and wherein grooves are formed in opposed inner sides of the table side panels, each of which extends from the flat top end of the table side panel to the vertical leading end, for receiving lateral ends of the first bottom piece.

2. A detachable table and chair assembly, comprising:

a table having spaced apart side panels, each formed with a flat top end, a leg end and a vertical leading end, a first bottom piece transversely formed between the side panels to define a first storage space, and a flat table top mounted on the flat top end of the side panels to cover the first storage space;

a chair having spaced apart side panels, each formed with a leg end, spaced apart transverse panels disposed between the side panels to integrally define a second storage space, and a seat panel pivotally mounted on an open top end of the second storage space, said seat panel being pivotable between a first position to close the second storage space and a second position to access the second storage space;

side bars in parallel relation, each having a leading end securely connecting the leg end of one of the table side panels and a rear end slidably connecting the leg end of one of the chair side panels; and wherein a bumper panel is provided for attaching to the vertical leading end of the table side panels to integrally define the first storage space.

3. A detachable table and chair assembly as claimed in claim 2, wherein a transverse groove is formed horizontally in an inner side of the bumper panel for receiving a leading end of the first bottom piece.

4. A detachable table and chair assembly, comprising:

a table having spaced apart side panels, each formed with a flat top end, a leg end and a vertical leading end, a first bottom piece transversely formed between the side panels to define a first storage space, and a flat table top mounted on the flat top end of the side panels to cover the first storage space;

a chair having spaced apart side panels, each formed with a leg end, spaced apart transverse panels disposed between the side panels to integrally define a second storage space, and a seat panel pivotally mounted on an open top end of the second storage space, said seat panel being pivotable between a first position to close the second storage space and a second position to access the second storage space;

side bars in parallel relation, each having a leading end securely connecting the leg end of one of the table side panels and a rear end slidably connecting the leg end of one of the chair side panels;

wherein said table top includes a fixed panel adjacent to the chair and mounted on the flat top end of the table side panels, and a folding panel pivotally connected to the fixed panel and being pivotable between a first position to close the first storage space and a second position to access the first storage space; and wherein a bracket member is provided under the fixed panel of the table top and disposed between the table side panels to mount the fixed panel on the flat top end of the table side panels.

5. A detachable table and chair assembly as claimed in claim 4, wherein the bracket member is shaped to form a notch between the fixed panel and bracket member for receiving a rear end of the first bottom piece.

6. A detachable table and chair assembly, comprising:

a table having spaced apart side panels, each formed with a flat top end, a leg end and a vertical leading end, a first bottom piece transversely formed between the side panels to define a first storage space, and a flat table top mounted on the flat top end of the side panels to cover the first storage space;

a chair having spaced apart side panels, each formed with a leg end, spaced apart transverse panels disposed between the side panels to integrally define a second storage space, and a seat panel pivotally mounted on an open top end of the second storage space, said seat panel being pivotable between a first position to close the second storage space and a second position to access the second storage space;

side bars in parallel relation, each having a leading end securely connecting the leg end of one of the table side panels and a rear end slidably connecting the leg end of one of the chair side panels;

wherein the side bar has a projection on top which receives a track member under the projection;

wherein the track member has a static part secured to the side bar and a movable part telescopically engaging the static part.

7. A detachable table and chair assembly as claimed in claim 6, wherein a rigid connecting member is provided for engaging the track member and chair side panel, said connecting member has spaced apart vertical side walls with an inner vertical side wall secured to the movable part of the track member and an outer vertical side wall attached to an inner side of the leg end of the chair side panel, and a flat bottom, which bridges a bottom end of the vertical side walls of the connecting member.

8. A detachable table and chair assembly as claimed in claim 7, wherein a shield member is longitudinally attached to the side bar and extends downwardly from the projection into a gap between the vertical side walls of the connecting member to cover the track member and inner vertical side wall of the connecting member.

9. A detachable table and chair assembly, comprising:

a table having spaced apart side panels, each formed with a flat top end, a leg end and a vertical leading end, a first bottom piece transversely formed between the side panels to define a first storage space, and a flat table top mounted on the flat top end of the side panels to cover the first storage space;

a chair having spaced apart side panels, each formed with a leg end, spaced apart transverse panels disposed between the side panels to integrally define a second storage space, and a seat panel pivotally mounted on an open top end of the second storage space, said seat panel being pivotable between a first position to close the second storage space and a second position to access the second storage space;

side bars in parallel relation, each having a leading end securely connecting the leg end of one of the table side panels and a rear end slidably connecting the leg end of one of the chair side panels;

wherein said table top includes a fixed panel adjacent to the chair and mounted on the flat top end of the table side panels, and a folding panel pivotally connected to the fixed panel and being pivotable between a first position to close the first storage space and a second position to access the first storage space; and wherein the folding panel is provided with an extension, which extends outwardly beyond the fixed panel when in its second position, and the folding panel folds over a top side of said fixed panel when said folding panel is in the second position.

10. A detachable table and chair assembly, comprising:

a table having spaced apart side panels, each formed with a flat top end, a leg end and a vertical leading end, a first bottom piece transversely formed between the side panels to define a first storage space, and a flat table top mounted on the flat top end of the side panels to cover the first storage space;

a chair having spaced apart side panels, each formed with a leg end, spaced apart transverse panels disposed between the side panels to integrally define a second storage space, and a seat panel pivotally mounted on an open top end of the second storage space, said seat panel being pivotable between a first position to close the second storage space and a second position to access the second storage space;

side bars in parallel relation, each having a leading end securely connecting the leg end of one of the table side panels and a rear end slidably connecting the leg end of one of the chair side panels; and wherein a second bottom piece is supported on the transverse panels of the chair to close a bottom opening of the second storage space, and grooves are formed in opposed inner sides of the transverse panels of the chair for receiving lateral ends of the second bottom piece.

* * * * *